US008684317B2

(12) United States Patent
Arnold

(10) Patent No.: US 8,684,317 B2
(45) Date of Patent: Apr. 1, 2014

(54) RAILROAD SWITCH POINT ROLLER MECHANISM

(76) Inventor: Jim Arnold, Grass Valley, CA (US)

( * ) Notice: Subject to any disclaimer, the term of this patent is extended or adjusted under 35 U.S.C. 154(b) by 8 days.

(21) Appl. No.: 13/200,786

(22) Filed: Sep. 30, 2011

(65) Prior Publication Data

US 2013/0082150 A1 Apr. 4, 2013

(51) Int. Cl.
*E01B 7/00* (2006.01)

(52) U.S. Cl.
USPC ..... 246/415 R; 246/453

(58) Field of Classification Search
USPC ..... 246/264, 268, 269, 415 R, 453
See application file for complete search history.

(56) References Cited

U.S. PATENT DOCUMENTS

| | | | | |
|---|---|---|---|---|
| 3,836,771 | A * | 9/1974 | Berst | 246/448 |
| 5,195,703 | A * | 3/1993 | Kais et al. | 246/443 |
| 5,499,786 | A * | 3/1996 | Durchschlag et al. | 246/448 |
| 5,501,418 | A | 3/1996 | Humphrey et al. | |
| 5,622,340 | A * | 4/1997 | Turner et al. | 246/415 R |
| 5,628,480 | A * | 5/1997 | Vrsecky et al. | 246/453 |
| 6,616,105 | B2 * | 9/2003 | Grunwald et al. | 246/430 |

* cited by examiner

*Primary Examiner* — R. J. McCarry, Jr.
*Assistant Examiner* — Jean Charleston
(74) *Attorney, Agent, or Firm* — Theodore J. Bielen, Jr.

(57) ABSTRACT

A railroad switch point roller mechanism utilized with a rail, a moveable point and a ground supported tie. The mechanism includes a roller or wheel which turns relative to a wheel axis. A wheel support is also employed and holds the wheel relative to the ground supported tie. The support connects to the moveable point, such that the lateral movement of the wheel relative to the ground supported tie takes place when the moveable point travels laterally relative to the rail. An adjustor is also included for finely determining the up or down position of the wheel relative to the tie and the wheel support.

5 Claims, 2 Drawing Sheets

RAILROAD SWITCH POINT ROLLER MECHANISM

BACKGROUND OF THE INVENTION

The present invention relates to a novel and useful railroad switch point roller mechanism which is used to support and guide a moveable rail or point.

Railroad switching mechanisms utilize moveable rails or point rails which interact with the rails of the main track. Point rails or "points" are relatively heavy and require a modest amount of force to switch the same between the main rails. Consequently, it is necessary to provide a smooth operation of the point between its positions relative to such rails.

In the past, points have been moved over bearing or plates to permit accurate sliding of the same. In addition, certain prior systems have added lubricating mechanism to the friction surfaces between the point and such plates.

Although, such prior art systems have been moderately successful, the tendency of the point to bend or snake as a necessitated the positioning of a roller beneath the point to ride on the bearing plates during the movement of the point.

However, there still a requirement to determine the height of a switch point roller in order to reduce friction and a ensure true switching of the same.

A switch point roller mechanism which allows the accurate spatial adjustment of the roller relative to the connected point would be a notable advance in the railroad arts.

SUMMARY OF THE INVENTION

In accordance with the present invention a novel and useful railroad switch point mechanism is here in provided.

The switch point roller mechanism utilizes a wheel which is turnable relative to an axis. The wheel support connects to the point allowing the movement of the wheel relative to the ground and a cross-tie supported by the ground therebelow.

The mechanism of the present invention also includes an adjustor which determines the vertical position of the wheel relative to the underlying tie and the wheel support. The adjustor may entail a rotatable shaft, which extends through the wheel, having an eccentric portion. The shaft serves as an axle for the wheel and is rotatable relative to the wheel such that the eccentric portion of the shaft moves the axis of the wheel vertically or downwardly relative to the axis of the shaft.

In addition, a sheet or plate, overlying the tie, may be provided upon which the wheel rolls during movement of the point. The sheet may include a ramp to further provide elevation of the end of the point during its movements in switching operations.

In addition, a further vertical adjustment of the wheel may be made where the wheel support includes a pair of roughened surfaces on separable portions of the wheel support. The two roughen surfaces are mated to one another by a tightening of a bolt or the like.

It may be apparent that a novel and useful railroad switch point roller mechanism has been hereinabove described.

It is therefore an object of the present invention to provide a railroad switch point roller mechanism that reduces the friction inherent in the movement of a railroad point from one position to another.

Another object of the present invention is to provide a wheel or roller in connection with a switching point in a railroad system in which the height of the roller, relative to an underlying surfaces, is accurately determined.

A further object of the present invention is to provide a roller useable with a moveable railroad point in which the height of the wheel relative to the underlying tie is adjustable by a rotatable shaft having an eccentric portion.

Another object of the present invention is to provide a railroad switch point roller mechanism that reduces the friction involved with the movement of a point in one position to another.

Another object of the present invention is to provide a railroad switch point roller mechanism that reduces the electrical load on motors associated with the switching mechanism for the point.

Yet another object of the present invention is to provide railroad switch point roller mechanism that may be easily installed on existing switch points in a simple and straightforward manner.

The invention possesses other objects and advantages especially as concerns particular characteristics and features thereof which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments. Such embodiment should be referenced to the prior delineated drawings.

Figure 1:
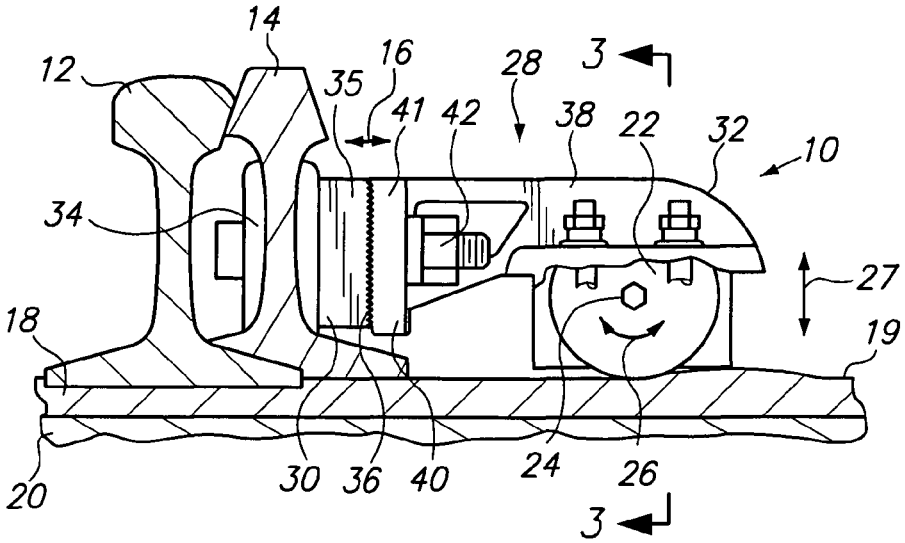
FIG. 1 is a side elevational view of the switch point roller mechanism in the present invention showing portions of the rail, point and tie in section and with a portion the housing surrounding the roller broken away.

An embodiment of the invention is depicted in the drawings by reference character 10. Railroad switch point roller mechanism 10 is used in conjunction with conventional railroad switching equipment, which includes railroad track 12 and switch point 14 (point, switch rail, point blade) Point 14 travels towards and away from track 12 according to directional arrow 16. Rail 12 is supported to a plate or sheet 18 which lies atop tie 20, that runs approximately perpendicularly relative to rail 12, FIG. 1. Plate or sheet 18 may also be fashioned with a ramp or hump 19.

Figure 2:
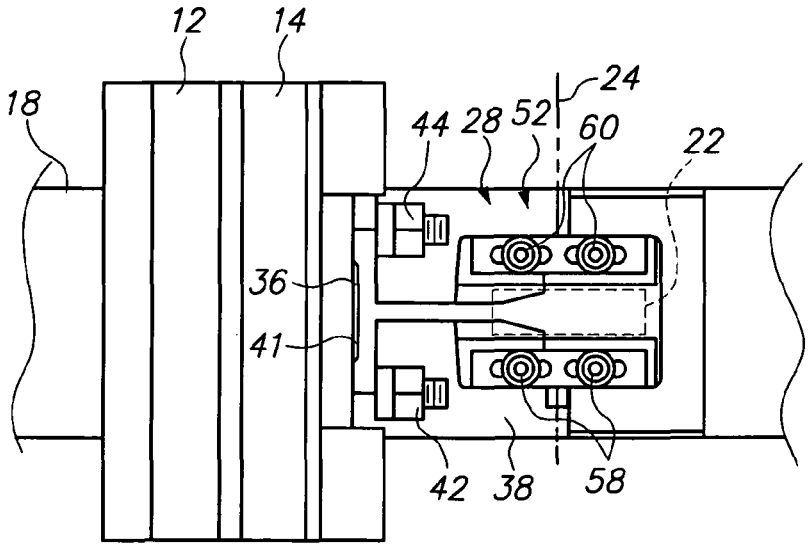
FIG. 2 is a top plan view of the roller mechanism depicted in FIG. 1, with the housing portion removed.
Figure 3:
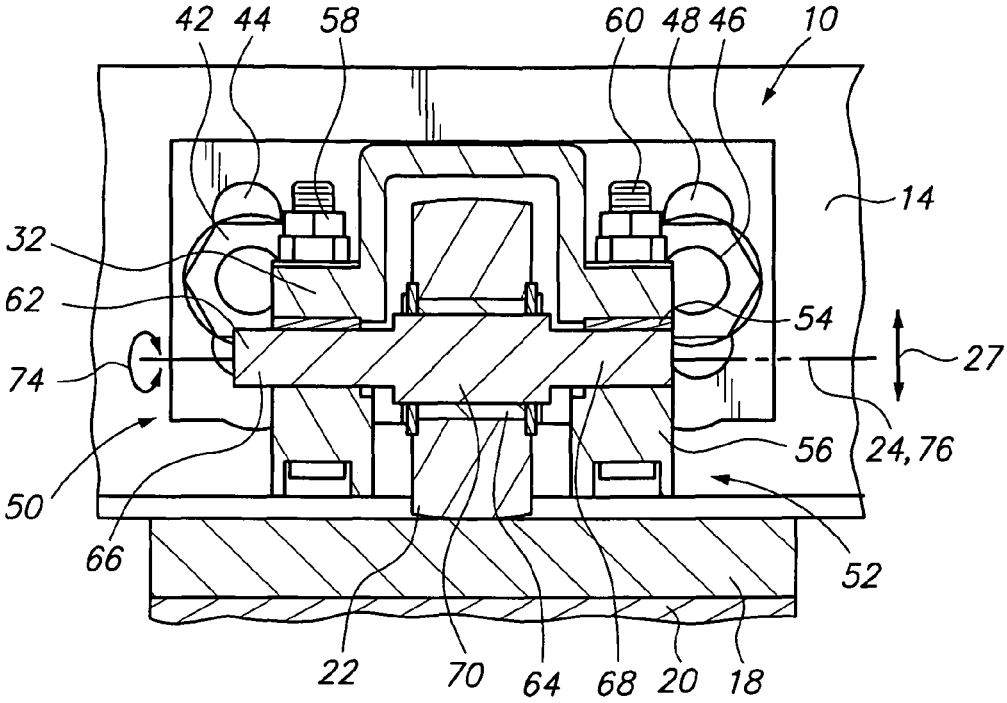
FIG. 3 is a sectional view taken along line 3-3 of FIG. 1.

Mechanism 10 also possesses as one of its elements a wheel or roller 22. Wheel 22 rotates about axis 24, directional arrow 26, FIGS. 1 and 2, and is adjustable upwardly or downwardly, directional arrow 27, FIGS. 1 and 3.

Wheel 22 is linked or connected to moveable point 14 via a support 28, such that the movement of point 14, according to directional arrow 16, also moves wheel 22 laterally relative to plate 18 and tie 20. Support 28 includes a first portion 30 and a second portion 32. First portion 30 fastens to switch point 14 via a bolt mounted base 34. A terminus 35 of first portion 30 includes a serrated or roughened surface 36. Second portion 32 of support 28 is provided with a housing 38. End piece 40 of second portion 32 is formed with a serrated or roughened surface 41, which is capable of engaging or mating with roughen surface 36 of first portion 30 of wheel support 28. A pair of nut and bolt pieces 42 and 44 allow the adjustable alignment of first portion 30 with end piece 42 via slots 44 and 46, respectively, FIG. 3, concomitant with the mating of surfaces 36 and 41.

An adjustor 50 is also employed in mechanism 10 for determining the up or down position of wheel 22 relative to sheet 18, tie 20, and wheel support 28. A clamp 52 possesses an upper plate 54 and a lower plate 56 that are forced together by nut and bolt assembles 58 and 60. Clamp 52 holds a rotatable shaft 62 which passes through wheel bushing assembly 64. Wheel 22 and bushing assembly 64 rotate relative to shaft 62, FIG. 3, which wil be discussed in greater detail as the specification continues.

Figure 4:
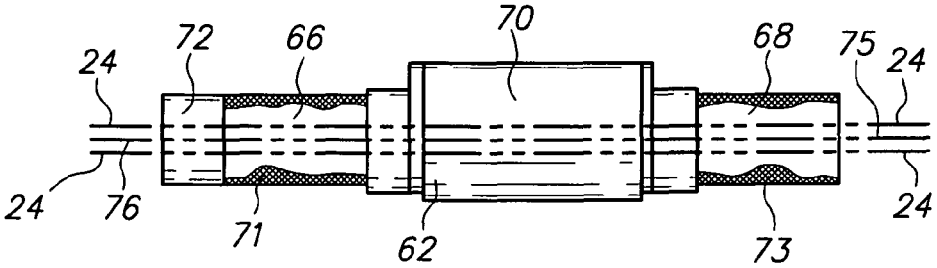
FIG. 4 is a side elevational view of the rotatable adjusting shaft, having an eccentric portion depicted in section on FIG. 3.
Figure 5:
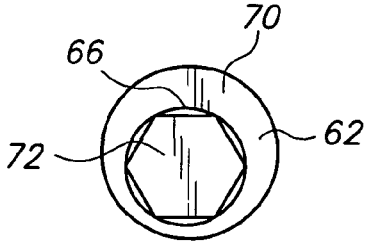
FIG. 5 is a left side end view of the shaft of FIG. 4.

Turning to FIGS. 4 and 5, it may be observed that rotatable shaft 62 is shown in further detail in which cylindrical portions 66 and 68 lie on either side of eccentric portion 70. A faceted end 72 connects to cylindrical portion 66 of shaft 26, FIGS. 4 and 5. Eccentric portion 70 of shaft 26 fits within bushing assembly 64 while cylindrical portions 66 and 68 are rotatably held by clamp 52, between plates 54 and 56. Cylindrical portions 66 and 68 are formed with knurled surfaces 71 and 73, shown partially in FIG. 4. It should be noted that shaft 26 may be rotated relative to clamp plates 54 and 56, directional arrow 74, FIG. 3. Needless to say, the turning of shaft 26 relative to clamp 52 will raise or lower wheel 22 and, consequently, point 14 relative to plate or sheet 18 and tie 20. With further reference to FIG. 4, it may be apparent that cylindrical portion 66 and 68 lie along axis 76 while eccentric portion 70 has been turned to adjust the axis 24 of wheel 22 upwardly or downwardly and, thus, lowers or raises the height of connected point 14. Wheel axis 24 is depicted in two positions in FIG. 4, in this regard. The turning of shaft 62, via engagement of faceted end 72 by a wrench or similar implement. It should be noted that mechanism 10 serves as a fine adjustment to the elevation of point 14 to allow the smooth travel of the same toward and away from track 12, along plate or sheet 18.

In operation, mechanism 10 is attached to the point 14 via nut and bolt assemblies 42 and 44. The tightening of nut and bolt assembly 42 and 44 will force the engagement of roughened surfaces 36 and 41 of first and second portions 30 and 32, respectively, of support 28. Such tightening constitutes a rough height adjustment of wheel 22 relative to plate 18. The turning of faceted portion 72 of shaft 62 cause eccentric portion 70 to rotate relative to bushing assembling 64 of wheel 22 and serves as a fine adjustment 52 for the height against movement of wheel 22 relative to plate 18. Of course, clamp 52 is tightened following the turning adjustment of shaft 62, via nut and bolt assemblies 58 and 60, squeezing upper and lower plates 54 and 56, respectively, together. Thus, mechanism 10 accurately adjust the height of wheel 22 and connected point 14 to allow smooth travel along plate or sheet 18 located above tie 20.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A railroad switch point roller mechanism employed with a rail, a moveable point, and ground supported tie, comprising:

a. a wheel, said wheel turnable relative to a wheel axis, b. a wheel support, said wheel support holding said wheel and being attached to said moveable point to permit back and forth movement of said wheel relative to the ground supported tie upon movement of said point; and c. an adjuster, said adjuster determining the up or down position of said wheel relative to the tie and said wheel support, said adjuster comprising a shaft, said shaft extending through said wheel, said shaft, further including an eccentric portion, said shaft serving as the axle of said wheel, said shaft being rotatable relative to said wheel to position said wheel axis relative to the tie and said wheel support.

2. The mechanism of claim 1 which additionally comprises a sheet, said sheet being positioned atop the tie, said sheet further including a surface, said wheel rolling on said surface with the travel of the moveable point, said sheet surface further including a ramp for urging the upward movement of said moveable point when said wheel contacts said ramp.

3. The mechanism of claim 2 in which said support comprises a first portion, a second portion, and a connector for mating said first and second portions.

4. The mechanism of claim 3 in which said first portion of said support includes a roughened surface, and said second portion of said support includes a roughened surface, said roughened surfaces of said first and second portions contacting one another upon said connector mating said first and second portion.

5. The mechanism of claim 4 in which said roughened surfaces of said first and second portions each comprise serrated surfaces.

* * * * *